US008224501B2

(12) United States Patent
Lassini et al.

(10) Patent No.: US 8,224,501 B2
(45) Date of Patent: Jul. 17, 2012

(54) STORE MANAGEMENT SYSTEM AND METHOD OF OPERATING THE SAME

(75) Inventors: Stefano Angelo Mario Lassini, Lowell, MI (US); Eric Daniel Buehler, Grand Rapids, MI (US)

(73) Assignee: General Electric Company, Schenectady, NY (US)

( * ) Notice: Subject to any disclaimer, the term of this patent is extended or adjusted under 35 U.S.C. 154(b) by 616 days.

(21) Appl. No.: 12/241,997

(22) Filed: Sep. 30, 2008

(65) Prior Publication Data

US 2010/0082183 A1 Apr. 1, 2010

(51) Int. Cl.
*G01C 23/00* (2006.01)

(52) U.S. Cl. ..... 701/3; 701/2; 701/23; 701/24; 701/118; 244/2; 244/190; 244/96

(58) Field of Classification Search ..... 114/21.2, 114/317, 338, 318; 244/2, 190, 96, 51, 87, 244/17.23, 12.1, 48, 167, 55, 13, 7 B; 701/23, 701/2, 3, 24, 118; 379/40, 102.05, 102.07
See application file for complete search history.

(56) References Cited

U.S. PATENT DOCUMENTS 5,036,465 A * 7/1991 Ackerman et al. ..... 235/400
5,091,847 A * 2/1992 Herbermann ..... 714/3
5,263,396 A * 11/1993 Ladan et al. ..... 89/1.11
6,038,502 A * 3/2000 Sudo ..... 701/23
6,615,116 B2 * 9/2003 Ebert et al. ..... 701/3
6,694,228 B2 * 2/2004 Rios ..... 701/2
6,763,289 B2 * 7/2004 Leonard et al. ..... 701/3
6,941,850 B1 * 9/2005 McMahon ..... 89/1.811
7,451,023 B2 * 11/2008 Appleby et al. ..... 701/24
7,542,828 B2 * 6/2009 Steele et al. ..... 701/3
7,581,702 B2 * 9/2009 Olson et al. ..... 244/189
7,610,841 B2 * 11/2009 Padan ..... 89/1.815
2003/0033059 A1 * 2/2003 Ebert et al. ..... 701/3
2004/0015273 A1 * 1/2004 Leonard et al. ..... 701/3
2005/0204910 A1 * 9/2005 Padan ..... 89/1.813
2009/0100995 A1 * 4/2009 Fisher ..... 89/1.11
2010/0217899 A1 * 8/2010 Sitzmann et al. ..... 710/69

OTHER PUBLICATIONS

MIL-STD-1553.*
MIL-STD-1760.*
Andreas Parsch, General Atomics RQ/MQ-1 Predator, 2004, Directory of U.S. Military Rockets and Missiles, Retrieved from: http://web.archive.org/web/20040604011405/http://www.designation-systems.net/dusrm/app2/q-1.html Archived: Jun. 4, 2004.*
MIL-STD-1553, Dec. 2002.*
MIL-STD-1760, Aug. 1, 2003.*

* cited by examiner

*Primary Examiner* — James P Trammell
*Assistant Examiner* — Truc M Do
(74) *Attorney, Agent, or Firm* — David J. Clement, Esq.; Armstrong Teasdale LLP

(57) ABSTRACT

A method for controlling an unmanned platform from a manned station is provided. The method includes transmitting a master arm control message from the manned station to the unmanned platform via a first control path, transmitting a first critical control message from the manned station to the unmanned platform via a second control path that is independent of the first control path, and transmitting a second critical control message from the manned station to the unmanned platform via a third control path that is different than the first control path and the second control path.

19 Claims, 6 Drawing Sheets

STORE MANAGEMENT SYSTEM AND METHOD OF OPERATING THE SAME

FIELD OF THE INVENTION

The field of the invention relates generally to a store management system, and more particularly, to a store management system that may be used with an unmanned platform.

BACKGROUND OF THE INVENTION

At least one known store management system (SMS) is used with manned platforms and/or vehicles, such as a manned aircraft. Such an SMS includes hard-wired controls that enable the pilot to control the weapons mounted on the vehicle, and facilitates ensuring a weapon is not inadvertently fired. For example, a known SMS includes a Master Arm switch that is hard-wired to the stores on the vehicle. The Master Arm switch is used to either arm or disarm all of the weapons on the vehicle. Moreover, the known SMS also includes a trigger switch that is hard-wired to each of the weapons on the vehicle to able selective firing of at least one of the weapons after the weapons have been armed. Accordingly, the known SMS uses hardware discretes, driven directly from cockpit switches, to enable hardware interlocks in the SMS and/or in the store suspension and release equipment. Such interlocks are usually independent of any software processes in the SMS and, thus, provide an independent control path to mitigate software hazards.

Further, in at least some known unmanned platforms, such as unmanned vehicles that include unmanned SMS platforms, all of the command and control information is transmitted through a data link from a ground station to the unmanned vehicle. Such a protocol provides a single hardware interlock for all weapon critical functions. In such an SMS platform, it is not possible to implement direct hard-wired interlocks between the actions of an operator in a ground station, such as selection of arming states and/or depression of trigger switches, and the unmanned SMS. As such, in such SMS systems, a software transient may adversely affect the unmanned SMS and/or cause the unmanned SMS to take unauthorized actions. Further, such a data link implemented communication may be complex and/or costly to analyze, as compared to the manned, hard-wired SMSs of manned platforms.

Accordingly, there is a need to extend the manned safety approach for stores management systems on manned platforms to unmanned SMS on unmanned platforms. Further, there is a need to ensure independent and analyzable interlocks to an unmanned SMS in an unmanned platform with a level of assurance equivalent to the level of assurance in a manned SMS in a manned platform.

BRIEF DESCRIPTION OF THE INVENTION

In one embodiment, a method for controlling an unmanned platform from a manned station is provided. The method includes transmitting a master arm control message from the manned station to the unmanned platform via a first control path, transmitting a first critical control message from the manned station to the unmanned platform via a second control path that is independent of the first control path, and transmitting a second critical control message from the manned station to the unmanned platform via a third control path that is different than the first control path and the second control path.

In another embodiment, a store management system (SMS) is provided. The SMS includes a manned station including a master arm control message encoder, a first critical control message encoder, and a second critical control message encoder. The SMS also includes an unmanned platform including a master arm control message decoder, a first critical control message decoder, and a second critical control message decoder. The SMS includes a data link between the manned station and the unmanned platform. The data link is configured to transmit a master arm control message from the master arm control message encoder to the master arm control message decoder, transmit a first critical control message from the first critical control message encoder to the first critical control message decoder, and transmit a second critical control message from the second critical control message encoder to the second critical control message decoder.

In yet another embodiment, a protocol for controlling an unmanned platform is provided. The protocol includes a first control path including a master arm control message encoder in communication with a master arm control message decoder, a second control path including a first critical control message encoder in communication with a first critical control message decoder, and a third control path including a second critical control message encoder in communication with a second critical control message decoder. The encoders are within a remote manned station and the decoders are within the unmanned platform.

The embodiments described herein utilize three independent control paths and/or control processes to control the release of stores from an unmanned platform. Further, each control path and/or process includes hardware and/or software that is independent from hardware and/or software in any other control path and/or process and from other components and/or elements of an SMS. As such, the embodiments described herein facilitate increasing the reliability and safety of an unmanned platform have weapons stored thereon, as compared to known wireless control paths and/or processes for controlling stores release from an unmanned platform.

DETAILED DESCRIPTION OF THE INVENTION

Figure 1:
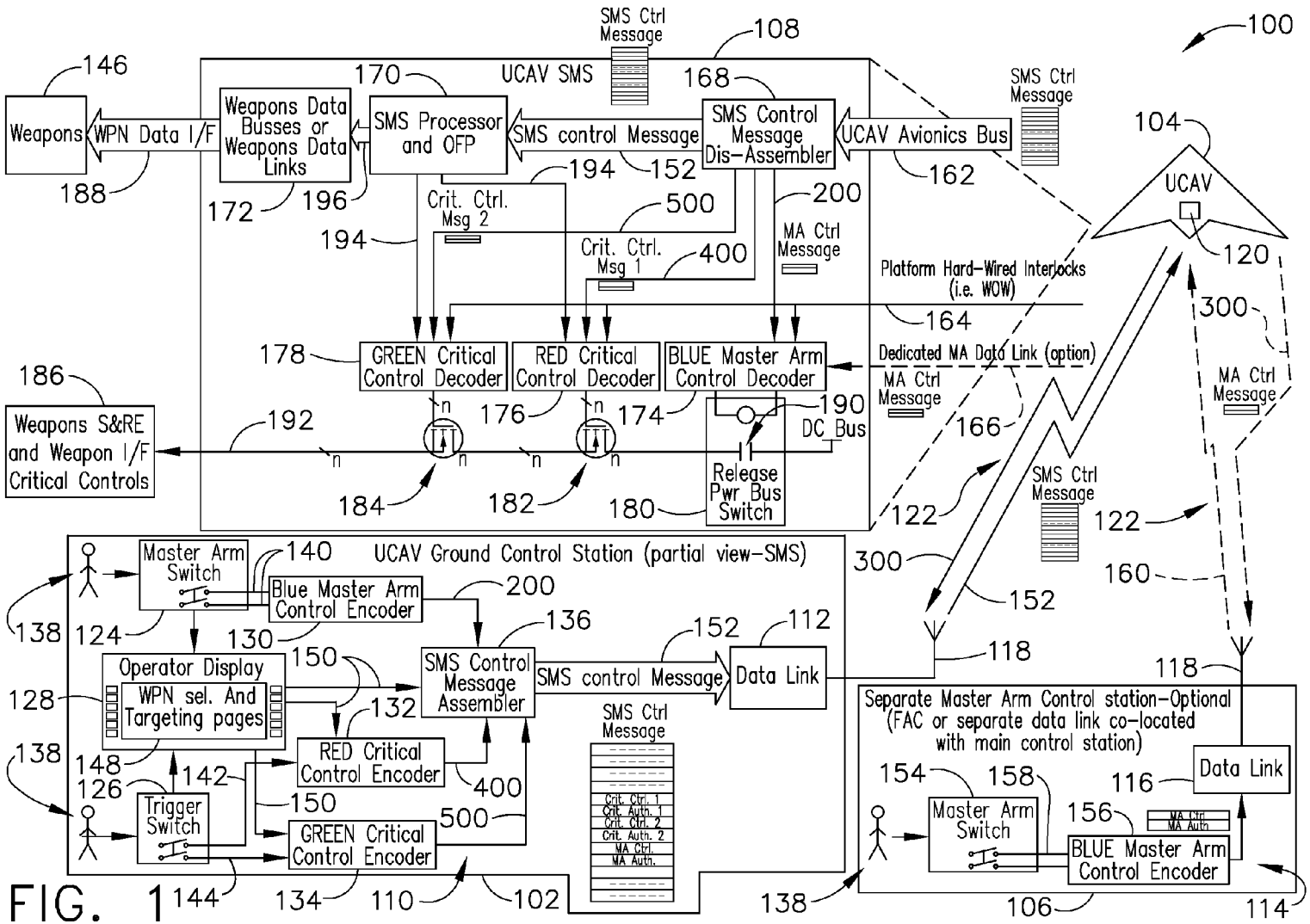
FIG. 1 is a schematic view of an exemplary protocol that may be used with at least a ground station and an unmanned vehicle.

The embodiments described herein function by establishing a protocol, or overall store management system (SMS), to synchronize a state of multiple hardware and software decision processes in a ground control station SMS and in an unmanned SMS. More specifically, the protocol and/or SMS described herein use multiple, independent hardware-based control processes in the unmanned SMS, such as RED, GREEN, and BLUE processes, and/or control paths described in more detail below, all of which cooperate to establish a control authority and specific critical control actions requested by the ground station to an unmanned platform having the unmanned SMS. As used herein, the terms "RED," "GREEN," and "BLUE" are merely used to distinguish three different control paths and/or processes and do not relate specifically to a color. As such, the three separate control paths and/or processes may be denoted by any suitable nomenclature, such as, for example, first control path/process, second control path/process, and third control path/process.

In the exemplary embodiment, the synchronization protocol provides a channel independent and software independent mechanism to synchronize a state of the ground station control processes with a corresponding unmanned vehicle control processes. Further, the protocol described herein provides a strong temporal correlation between the changes in the state of one process pair, for example, a transition from "Idle" to "Enabled" status for the BLUE process, and corresponding commands for the other control processes, to facilitate preventing out-of-order command delivery from an underlying data channel.

Moreover, the protocol described herein provides an authentication mechanism to ensure that the synchronization between the ground station and the unmanned processes is accomplished only when specified conditions are satisfied to facilitate preventing mis-delivery of synchronization commands by the underlying data channel. Such authentication can be extended to ensure that only specified conditions of the ground control hardware can authenticate to the unmanned hardware. More specifically, the protocol includes a mechanism to ensure that the unmanned hardware processes will autonomously transition to a safe state, or fail-safe state, if a loss of communication, and/or errors in the synchronization, occur.

Additionally, the protocol described herein includes a mechanism for use in precisely timing the execution of critical actions by the unmanned SMS according to specific platform Concept of Operations (CONOPS) and doctrine, such that different classes of critical actions have different execution disciplines to ensure accurate release of stores, independent of network delays present in a control channel between the ground station and unmanned elements.

The embodiments described herein extend the use of hardware interlocks used in manned platforms to the generation of critical control messages for individual stores within the unmanned SMS. Such an extension is applicable to SMSs installed in both manned and/or unmanned platforms. As described herein, each process in the unmanned SMS has a corresponding process in the manned ground station SMS, and are directly controlled using discrete hardware interlocks, as are similarly used with a manned platform. More specifically, the embodiments described herein use a subset of the RED/GREEN/BLUE hardware control processes to generate strong checksums, as defined by applicable weapon control standards and individual weapon Interface Control Documents, for the critical control requests issued by an SMS Operational Flight Program (OFP). As such, each of the hardware control processes described herein independently evaluates the state of platform interlocks and/or any other relevant safety information. Accordingly, a proper checksum is issued only if all the relevant safety conditions are satisfied.

Accordingly, the embodiments described herein extend a fine-grained level of hardware-based interlocks to an aspect of SMS that has been traditionally under exclusive software control, thus, mitigating potential software hazards, increasing the level of overall safety assurance of the system, and reducing a need for expensive software assurance testing and validation. Examples of the fine-grained interlock policies available include, but are not limited to including, the following: (a) individually interlocking all the possible critical control commands to a store using different interlock equations, and (b) interlocking critical control commands to multiple stores to enforce in hardware the timing and sequencing policies that, in traditional approaches, would have been under exclusive software control.

FIGS. 1-6 illustrate an exemplary protocol for controlling an unmanned platform from a remote, manned platform. The exemplary protocol is considered to be an overall SMS that includes an SMS on the unmanned platform and an SMS in the manned platform. In the exemplary embodiment, the protocol is used to control an unmanned aircraft having an unmanned SMS thereon from a manned ground station having a manned SMS thereon. It will be understood by one of ordinary skill in the art that the protocol described herein may be used with any manned SMS and unmanned SMS that are in communication, and the present invention is not limited to only the embodiments described herein.

FIG. 1 illustrates a schematic view of an exemplary protocol 100 that may be used with at least a ground station 102 and an unmanned vehicle 104. Optionally, in the exemplary embodiment, protocol 100 also includes a separate master arm control station 106. Protocol 100 is an overall SMS that includes at least an SMS at ground station 102 and an SMS at unmanned vehicle 104. In the exemplary embodiment, ground station 102 is operated by human personnel for controlling unmanned vehicle 104. As such, ground station 102 is considered to be a "manned platform." Ground station 102 can be located within an arena of operation of unmanned vehicle 104 or can be remote from the arena of operation. In the exemplary embodiment, ground station 102 is located remote from the arena of operation. Moreover, unmanned vehicle 104 may be any suitable unmanned vehicle and/or platform that includes a weapons store thereon. In the exemplary embodiment, unmanned vehicle 104 is an unmanned combat air vehicle (UCAV). Within the present application, the terms "unmanned vehicle," "unmanned platform," "airborne vehicle," "UCAV," and/or other similar terms are used interchangeably herein, although it will be understood the descriptions herein of protocol 100 can be extended for using protocol 100 with any suitable manned and/or unmanned platform. In the exemplary embodiment, protocol 100 includes optional separate master arm control station 106. Separate master arm control station 106 can be located within the arena of operation of unmanned vehicle 104 or can be located remote from the arena of operation. In the exemplary embodiment, separate master arm control station 106 is located within the arena of operation, but is remote from UCAV 104.

UCAV 104, in the exemplary embodiment, includes a store management system (SMS) 108, also referred to herein as an unmanned SMS. As such, UCAV 104 is considered to be an unmanned SMS platform. Ground station 102 also includes an SMS 110. SMS 110 is also referred to herein as a manned SMS and/or a ground station SMS. Unmanned SMS 108 and ground station SMS 110 are in communication via a data link 112. In the exemplary embodiment, separate master arm control station 106 includes an SMS 114. SMS 114 is also referred to herein as a manned SMS and/or a master arm SMS. Unmanned SMS 108 and master arm SMS 114 are in communication via a secondary data link 116. In the exemplary embodiment, data links 112 and 116 are implemented using a transmit/receive antenna 118 at a respective manned SMS 110 or 114 and a transmit/receive antenna 120 on UCAV 104 to send and receive radio frequency (RF) signals 122. Alternatively, data links 112 and/or 116 are implemented using any suitable wireless communication data link.

Ground station SMS 110 includes, in the exemplary embodiment, a master arm switch 124, a release switch or trigger switch 126, an operator display 128, a master arm control encoder 130, a first critical control encoder 132, a second critical control encoder 134, an SMS control message assembler 136, and data link 112. Switches 124 and 126 are each controlled by human interaction 138. The same person or different people may provide human interaction 138 for controlling switch 124 and/or switch 126. For example, when the human operator switches master arm switch 124 to ON from OFF, or to ARM from SAFE, or to OFF from ON, or to SAFE from ARM, switch 124 generates a master arm control signal 140 that is transferred to master arm control encoder 130.

Further, when the human operator turns trigger switch 126 to ON from OFF, or to OFF from ON, switch 126 generates a first critical control signal 142 and a second critical control signal 144, that each contain the same information, and that are transferred to first critical control encoder 132 and to second critical control encoder 134, respectively. When more than one weapon 146 is to be released, first and second critical control signals 142 and 144 are generated for each weapon 146 to be released. In the exemplary embodiment, operator display 128 is a computer-based display that enables at least one person to control switches 124 and/or 126, and/or SMS 110 and/or 108. More specifically, operator display 128 provides an operator interface 148 for use in selecting an UCAV 104, a weapon 146, and/or a target, and generates true selection data 150 based on the human operator's selections. More specifically, true selection data 150 are encoded in critical control messages 400 and 500 by first and second critical control encoders 132 and 134, as described in more detail below.

In the exemplary embodiment, master arm control encoder 130 communicates with master arm switch 124 to encode a master arm control message 200. Control message 200 is described in more detail below with respect to FIGS. 2 and 3. As used herein, the "BLUE" control path and/or process is a master arm control path and/or process for use in arming and/or disarming all weapons 146 coupled within UCAV 104. As such, in the exemplary embodiment, master arm control encoder 130 is also referred to herein as BLUE encoder and master arm control message 200 is also referred to herein as BLUE control message. In the exemplary embodiment, encoder 130 is an independent field-programmable gate array (FPGA) that includes a plurality of programmed logic gates. Alternatively, encoder 130 is software on a dedicated microprocessor. As such, encoder 130, as an FPGA or as software on a dedicated microprocessor, is simple to analyze, as compared to inter-dependent software. In the exemplary embodiment, BLUE control message 200 includes a signal that includes encoded information related to actions to be implemented after the human operator has made a selection.

In the exemplary embodiment, first critical control encoder 132 communicates with trigger switch 126 and operator display 128 for encoding a first critical control message 400. Control message 400 is described in more detail below with respect to FIG. 4. As used herein, the "RED" control path and/or process is a first critical control path and/or process for use in controlling targeting and timing of weapon 146, and, as such, first critical control encoder 132 is also referred to herein as RED encoder and first critical control message 400 is also referred to herein as RED control message. In the exemplary embodiment, encoder 132 is an independent FPGA that includes a plurality of programmed logic gates. Alternatively, encoder 132 is software on a dedicated microprocessor. As such, encoder 132, as an FPGA or as software on a dedicated microprocessor, is relatively simple to analyze, as compared to inter-dependent software. In the exemplary embodiment, RED control message 400 includes a signal that has encoded information associated with the actions to be implemented after the human operator has made a selection.

In the exemplary embodiment, second critical control encoder 134 communicates with trigger switch 126 and operator display 128 to encode a second critical control message 500. More specifically, in the exemplary embodiment, second critical control message 500 contains the same critical control information as first critical control message 400 such that the same critical control information is encoded twice. Control message 500 is described in more detail below with respect to FIG. 5. As used herein, the "GREEN" control path and/or process is a second critical control path and/or process for controlling targeting and timing of weapon 146 and, as such, second critical control encoder 134 is also referred to herein as GREEN encoder and second critical control message 500 is also referred to herein as GREEN control message. In the exemplary embodiment, encoder 134 is an independent FPGA that includes a plurality of programmed logic gates. Alternatively, encoder 134 is software on a dedicated microprocessor. As such, encoder 134, as an FPGA or as software on a dedicated microprocessor, is relatively simple to analyze, as compared to inter-dependent software. In the exemplary embodiment, GREEN control message 500 includes a signal that has encoded information related to the actions to be implemented after the human operator has made a selection.

Operator display 128 is coupled in communication with RED encoder 132, GREEN encoder 134, and SMS control message assembler 136. In the exemplary embodiment, true selection data 150 is transferred from operator display 128 to encoders 132 and 134 and to assembler 136 to enable encoding of selection data 150 into critical control messages 400 and 500 and to enable assembling os selection data 150 into an SMS control message 152. More specifically, assembler 136 receives BLUE control message 200, RED control message 400, GREEN control message 500, and selection data 150, and in response, assembles messages 200, 400, and 500 and data 150 into SMS control message 152. SMS control message 152 is transferred to UCAV 104 via data link 112.

In the exemplary embodiment, separate master arm control station 106 includes a secondary master arm switch 154, a secondary master arm control encoder 156, and secondary data link 116. Switch 154 is controlled by human interaction 138. When an operator turns master arm switch 154 to ON from OFF, or to OFF from ON, switch 154 generates a secondary master arm control signal 158 that is transmitted to secondary master arm control encoder 156. More specifically, secondary master arm control encoder 156 communicates with secondary master arm switch 154 and encodes a secondary master arm control message 160. Secondary master arm control message 160 is generally similar to BLUE control message 200. Secondary master arm control message 160 is transmitted by secondary data link 116 to UCAV 104.

Secondary master arm switch 154, secondary master arm control encoder 156 and secondary master arm control message 160 are considered part of the BLUE process and/or control path because switch 154, encoder 156, and control message 160 are used to arm and/or disarm all weapons 146 coupled to UCAV 104. More specifically, secondary master arm control message 160 can override master control message 200. For example, when master arm control station 106 is within the arena of operation, and ground station 102 is remote from the arena of operation, an operator at master arm control station 106 may be aware of conditions that an operator at ground station 102 may not be aware of, and as such, the operator at separate master arm control station 106 can override an arm or disarm command issued by the human operator at ground station 102 with secondary BLUE control message 160. Alternatively, protocol 100 does not include separate master arm control station 106, and UCAV 104 is controlled only by a human operator at ground station 102. In the exemplary embodiment, encoder 156 is an independent FPGA that includes a plurality of programmed logic gates. Alternatively, encoder 156 is software on a dedicated microprocessor. As such, encoder 156, as an FPGA or as software on a dedicated microprocessor, is simple to analyze, as compared to interdependent software.

In the exemplary embodiment, UCAV antenna 120 receives SMS control message 152 and/or secondary master arm control message 160. Antenna 120 transmits a status message 300 to ground station 102 and/or to master arm control station 106. Status message 300 is described in more detail below with respect to FIG. 2. In the exemplary embodiment, SMS control message 152 and/or secondary master arm control message 160 are used within UCAV SMS 108 to control weapons 146 coupled to UCAV 104. More specifically, SMS control message 152 is transferred to SMS 108 via an avionics bus 162. SMS control message 152 is also transferred to SMS 108 via platform hard-wired interlocks 164 to message decoders, as described in more detail below. Hard-wired interlocks 164 are substantially similar to the hard-wired interlocks used within a manned platform and provide three independent interlocks for transferring messages to message decoders. Moreover, in an alternative embodiment, BLUE control message 200 and/or 160 may optionally be transferred to UCAV SMS 108 via a dedicated master arm data link 166. More specifically, an alternative UCAV includes a plurality of antennas and receivers such that master arm data link 166 is dedicated to BLUE control message 200 and avionics bus 162 is dedicated to RED control message 400 and GREEN control message 500.

In the exemplary embodiment, optional hard-wired interlocks 164 facilitate integration of unmmaned platform capabilities with ground station SMS 102. More specifically, depending on the features and/or capabilities of UCAV 104, additional information related to the platform features and/or capability of UCAV 104 are transmitted from hardware on UCAV 104 to UCAV SMS 108. For example, if UCAV 104 includes a bay having doors that open to release a weapon, individual discretes related to the status of the doors is transmitted by hard-wired interlocks 164 to SMS 108. Decoders 174, 176, and/178 receive the discretes. If the discretes indicate that the doors are closed, decoders 174, 176, and/or 178 are inhibited from releasing a weapon 146. As such, the individual discretes transmitted hard-wired interlocks 146 are specific to a type of UCAV 104 and inhibit or allow an action by SMS 108 depending on the status of UCAV hardware and/or software other than SMS 108.

Use of SMS control message 152 for controlling weapons 146 is described herein, but it will be understood that a similar description applies when secondary master arm control message 160 is used for controlling weapons 146. However, only secondary master arm control message 160 performs the BLUE functions described below. In the exemplary embodiment, SMS 108 includes an SMS control message dis-assembler 168, an SMS processor and OFP 170, weapons data busses and/or links 172, a master arm control decoder 174, a first critical control decoder 176, a second critical control decoder 178, a power bus switch 180, a first critical control transistor 182, and a second critical control transistor 184. Further, at least one weapon 146 is coupled to UCAV 104 using weapon suspension and release equipment including a weapon interface critical controls 186. Weapon suspension and release equipment including a weapon interface critical controls 186 is also referred to herein a store payload controller (SPC). UCAV 104 includes an SPC 186 for each weapon 146 stored thereon. Master arm control decoder 174 is considered part of BLUE control path and/or process, and may also be referred to herein as BLUE decoder. First critical control decoder 176 is considered part of RED control path and/or process and may be referred to herein as RED decoder. Second critical control decoder 178 is considered part of GREEN control path and/or process and may be referred to herein as GREEN decoder.

In the exemplary embodiment, dis-assembler 168 is coupled in communication with avionics bus 162, decoders 174, 176, and 178, and SMS processor and OFP 170. SMS processor and OFP 170 is coupled in communication with dis-assembler 168, with critical control decoders 176 and 178, and with weapons data busses/links 172. Weapons data busses/links 172 are coupled in communication with weapons 146 through a weapons data interface 188. Further, in the exemplary embodiment, BLUE decoder 174 in coupled in communication with hard-wire interlocks 164 and with optional dedicated master arm data link 166 for receiving individual discretes and BLUE control message 200, respectively. Similarly, RED decoder 176 is coupled in communication with hard-wire interlocks 164 for receiving individual discretes, and GREEN decoder 178 is coupled in communication with hard-wire interlocks 164 for receiving individual discretes.

Moreover, in the exemplary embodiment, BLUE decoder 174 is coupled in communication with power bus switch 180, RED decoder 176 is coupled in communication with first transistor 182, and GREEN decoder 178 is coupled in communication with second transistor 184. Power bus switch 180 includes an air gap 190 that is closed and/or opened based on BLUE control message 200. First transistor 182 may also be referred to herein as RED transistor, and second transistor 184 may also be referred to herein as GREEN transistor. Moreover, in the exemplary embodiment, UCAV SMS 108 includes n number of RED transistors 182 and n number of GREEN transistors 184, wherein n is equal to the number of weapon stations on UCAV 104. More specifically, one RED transistor 182 and one GREEN transistor 184 corresponds to each weapon station for use in controlling the weapon attached thereto. When more than one weapon 146 is to be released, a separate RED control message 400 is transmitted to each RED transistor 182 corresponding to the selected weapons and a separate GREEN control message 500 is transmitted to each GREEN transistor 184 corresponding to the selected weapons.

In the exemplary embodiment, power bus switch 180 is coupled in series with RED transistor 182 and with GREEN transistor 184. As such, switch 180, transistor 182, and transistor 184 function as an AND logic gate. More specifically, switch 180, transistor 182, and transistor 184 function as the logic gate "BLUE AND RED AND GREEN" such that each of switch 180, transistor 182, and transistor 184 must be activated to generate a release signal 192 that is transmitted to a corresponding SPC 186 for releasing a weapon 146 coupled to SPC 186. As such, if a transient occurs in switch 180, transistor 182, or transistor 182, UCAV SMS 108 will not release a weapon 146 without the other two components being activated. Moreover, because of the configuration of switch 180, n RED transistors 182, and n GREEN transistors 184, when switch 180 is activated by BLUE control message 200, a human operator and/or SMS 110 and/or 108 can detect if a transistor 182 and/or 184 is stuck in an ON position. Accordingly, the configuration of switch 180, n RED transistors 182, and n GREEN transistors 184 facilitates an analysis and/or an inspection of protocol 100.

When UCAV 104 receives SMS control message 152, in the exemplary embodiment, message 152 is transmitted to dis-assembler 168 via bus 162. SMS control message 152 is dis-assembled into BLUE control message 200, RED control message 400, and GREEN control message 500. Dis-assembler 168 transmits SMS control message 152 to SMS processor and OFP 170 to confirm a requests command. More specifically, SMS processor and OFP 170 executes a program that validates that BLUE, RED, and GREEN control messages 200, 400, and 500, respectively, were received to command a weapon release. As such, SMS processor and OFP 170 provides a post-release check of a command based on a software state of unmanned platform 104.

Further, in the exemplary embodiment, SMS processor and OFP 170 transmit a message 194 to RED decoder 176 and GREEN decoder 178 to inhibit, modify, and/or delay a weapon release, depending on a type of unmanned platform. For example, when SMS processor and OFP 170 calculates when to release a weapon after receiving control messages 200, 400, and 500, as described below, message 194 inhibits a weapons 146 to be released until a calculated time and/or allows the weapons 146 to be released at the calculated time. Further, SMS processor and OFP 170 transmit operational data 196 to weapons 146 via weapons data busses/links 172 and weapons data interface 188. More specifically, control messages 200, 400, and/or 500 include operational information, such as targeting information and/or other suitable instruction, that is used by a particular weapons store for releasing a weapon 146. Such information is transmitted as operational data 196 from SMS processor and OFP 170 to a particular weapon store for controlling an associated weapon 146.

Further, dis-assembler 168 transmits BLUE control message 200 to BLUE decoder 174, RED control message 400 to RED decoder 176, and GREEN control message 500 to GREEN decoder 178. Transmission of BLUE control message 200 is described in more detail below with respect to FIG. 3. Further, an exemplary control message transmission sequence is described in more detail below with respect to FIG. 6. If BLUE decoder 174 receives a BLUE control message 200 to arm weapons 146, BLUE decoder 174 activates power bus switch 180 to close air gap 190. When power bus switch 180 is activated, weapons 146 are ready to be released. If BLUE decoder 174 receives a BLUE control message 200 to disarm weapons 146, BLUE decoder 174 deactivates power bus switch 180 to open air gap 190 such that weapons 146 are not ready to be released. Once weapons 146 are armed and UCAV SMS 108 receives RED and GREEN control messages 400 and 500, RED decoder 176 turns on RED transistor 182 for a specified station SPC 186 on UCAV 104, and GREEN decoder 178 turns on GREEN transistor 184 for the same specified station SPC 186. When switch 180 is activated, and transistors 182 and 184 are on, release signal 192 is transmitted to SPC 186 to release a corresponding weapon 146.

As described above, in the exemplary embodiment, protocol 100 includes three control paths and/or processes for arming and releasing a weapon. More specifically, protocol 100 includes one master arm control process and/or control path (BLUE) and two redundant critical control processes and/or control paths (RED and GREEN). Furthermore, each separate encoder 130, 132, and 134 in ground station 102 is matched to a corresponding decoder 174, 176, and 178, respectively, in UCAV 104. Each encoder/decoder set is independent from other components of protocol 100 such that each encoder/decoder set does not erroneously transmit a control message. Moreover, by using the encoder/decoder sets, the safety components of SMS 108 and/or 110 are self-contained and relatively simple to analyze and/or test.

Figure 2:
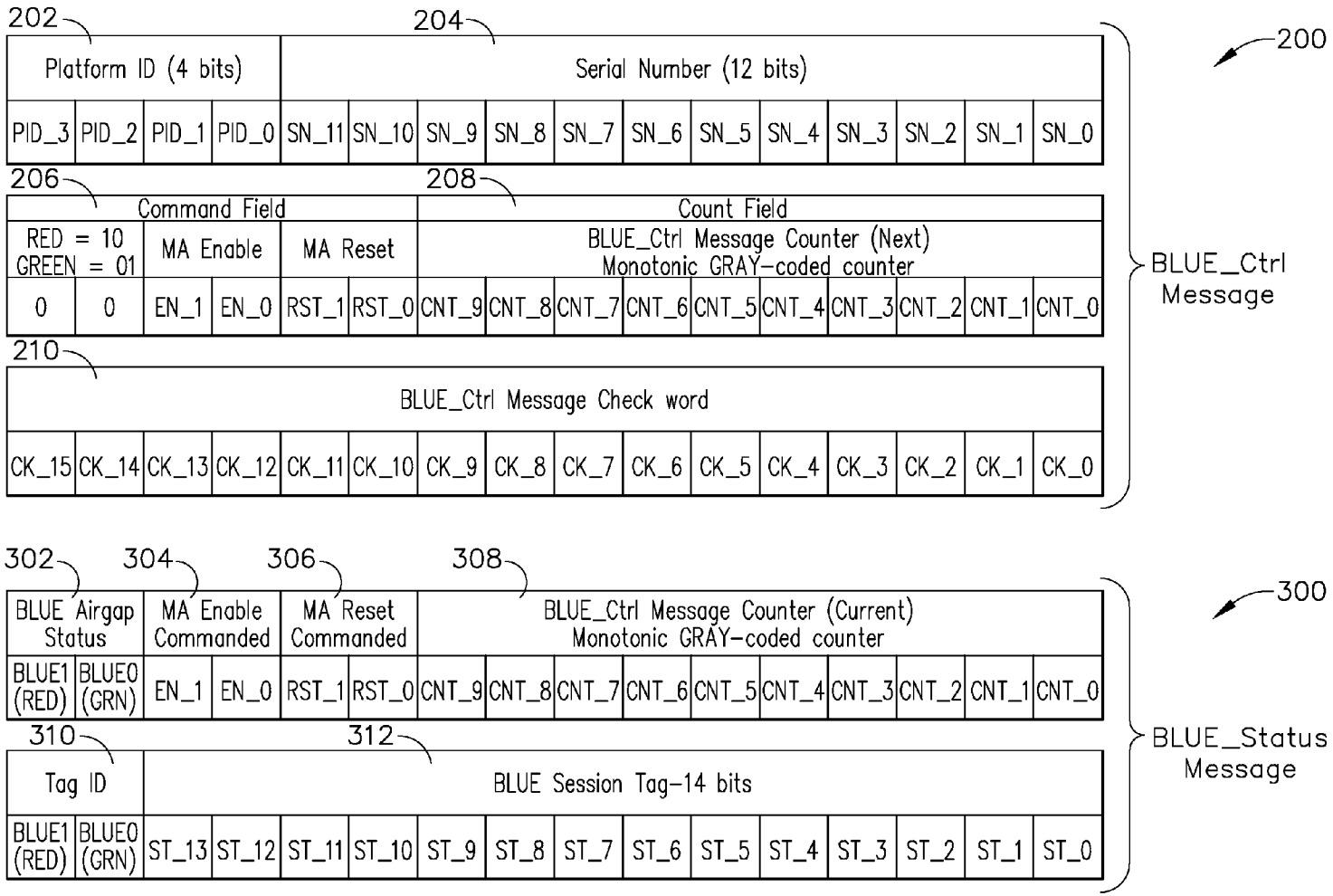
FIG. 2 is a diagram of exemplary master arm control and status message that may be used with the protocol shown in FIG. 1.

FIG. 2 is a diagram of master arm (BLUE) control message 200 and master arm status message 300 that may be used with protocol 100 (shown in FIG. 1). Master arm status message 300 is also referred to herein as a BLUE status message. Although BLUE control message 200 and BLUE status message 300 are described herein as being part of the communications between UCAV 104 (shown in FIG. 1) and ground station 102 (shown in FIG. 1), it will be understood that control message 200 and status message 300 are substantially similar for communications between UCAV 104 and separate master arm control station 106.

In the exemplary embodiment, BLUE control message 200 includes a platform identification 202, a serial number 204, a command field 206, a count field 208, and a check word 210. More specifically, platform identification 202 includes data that indicates which type of UCAV is to receive BLUE control message 200, and serial number 204 includes data that indicates which specific UCAV of the specified type is to receive BLUE control message 200. Command field 206 includes data that indicates whether to arm and/or disarm UCAV 104 and/or to reset UCAV SMS 108 (shown in FIG. 1). Check word 210 is a high integrity checksum for guaranteeing that any error in the transmission of BLUE control message 200 does not effect other components of UCAV SMS 108. Count field 208 functions as a watchdog timer.

More specifically, count field 208 includes data that indicates whether any communication is ongoing between UCAV 104 and ground station 102. In the exemplary embodiment, when BLUE control message 200 arms UCAV 104, power bus switch 180 (shown in FIG. 1) remains activated until UCAV 104 is disarmed, and/or BLUE control message 200 expires, as described in more detail with respect to FIG. 3. Count field 208 periodically checks BLUE control message 200 by incrementing upward each time communication between UCAV 104 and ground station 102 is detected. If the incrementing of count field 208 stops, UCAV SMS 108 is notified that transmission of BLUE control message 200 from ground station 102 has been lost. All messages 200, 400, and 500 within UCAV SMS 108 are reset such that actions of UCAV 104 are aborted.

In the exemplary embodiment, BLUE status message 300 includes an air gap status 302, an enable commanded 304, a reset commanded 306, a message counter 308, a tag identification 310, and a session tag 312. Air gap status 302 includes information that indicates whether air gap 190 (shown in FIG. 1) is open or closed, enabled commanded 304 includes information that indicates whether UCAV 104 is armed or disarmed, and reset commanded 306 includes information that indicates whether UCAV SMS 108 has been reset. Message counter 308 includes information that indicates the current increment in count field 208. As such, message counter 308 indicates whether communication between UCAV 104 and ground station 102 has been lost or is ongoing. Session tag 312 includes information that indicates a period during which UCAV 104 is armed. More specifically, a session tag is generated for each period during which UCAV 104 is armed and a corresponding session tag is encoded within critical control messages 400 and 500 (shown in FIGS. 4 and 5). If count field 208 and/or message counter 308 indicates that communication has been lost because the counts do not correspond, the session tag expires and UCAV 104 operates in a fail-safe mode.

Figure 3:
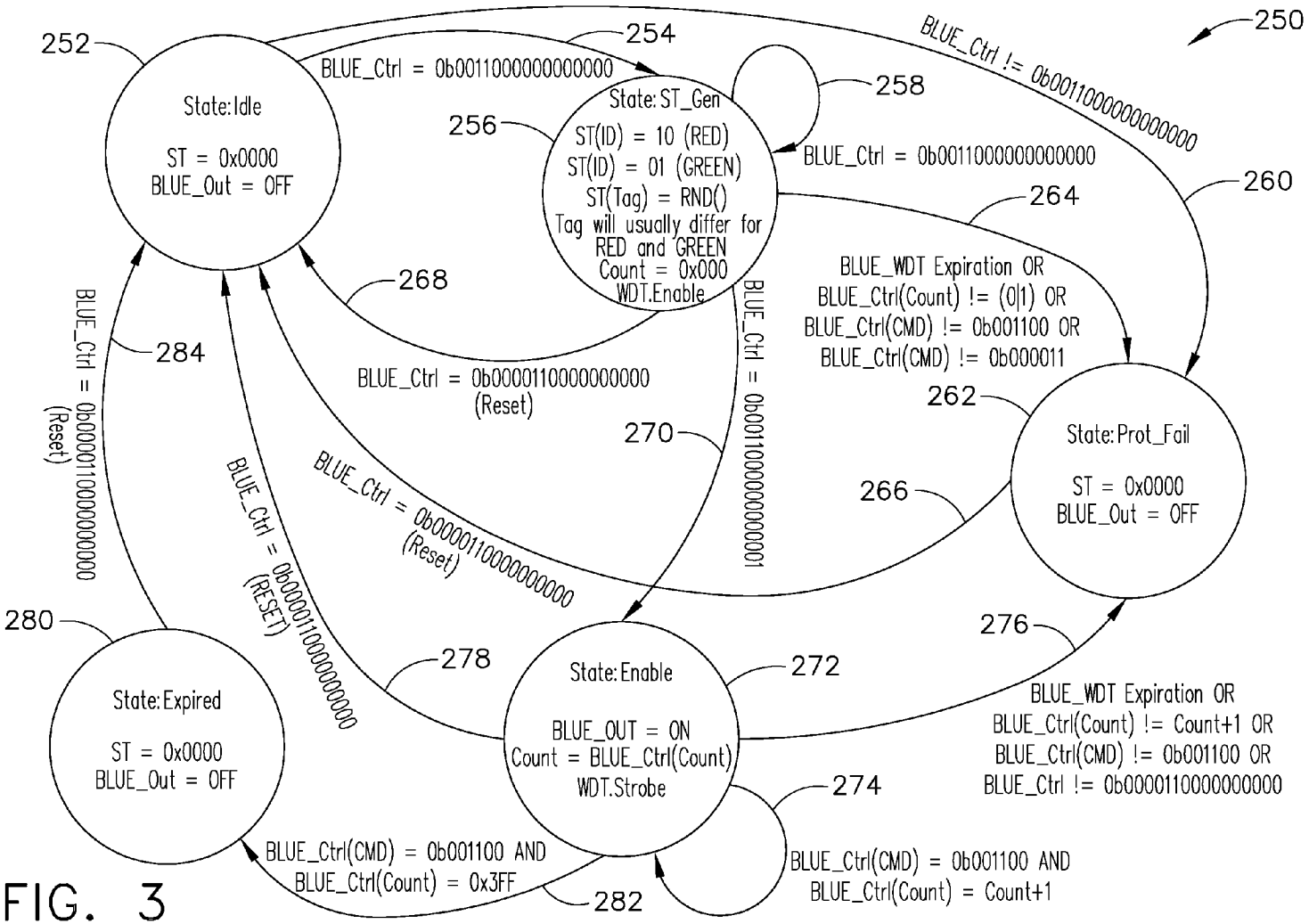
FIG. 3 is a block diagram of an exemplary master arm process that may be used with the protocol shown in FIG. 1.

FIG. 3 is a block diagram of an exemplary master arm process 250 that may be used with protocol 100 (shown in FIG. 1). Process 250 is also referred to herein as a BLUE state machine. BLUE state machine 250 may perform anywhere within UCAV SMS 108 (shown in FIG. 1), but, in the exemplary embodiment, BLUE state machine 250 functions within SPC 186 (shown in FIG. 1). In the exemplary embodiment, process 250 includes a series of BLUE control messages 200 (shown in FIG. 2) that are sent at a predetermined frequency that facilitates preventing a watchdog timer from expiring. As will be understood, timing parameters used with process 250 are application specific and are subject to tuning.

In the exemplary embodiment, process 250 starts with UCAV SMS 108 at an "Idle" state 252. Idle state 252 is attained with UCAV power up and/or after a Reset Command from any state. During Idle state 252, BLUE outputs (BLUE Out) are set to OFF, and Session Tag (ST) is set to 0x0000. When BLUE control message 200 is received by UCAV 104 (shown in FIG. 1), state machine 250 enters 254 a "Generating" state 256 (ST_Gen) from Idle state 252 if BLUE control message 200 is proper. More specifically, Generating state 256 is reached from Idle state 252 after an Enable command with a count==0 has been received. During Generating state 256, a Session Tag for the appropriate RED or GREEN element is generated randomly. Moreover, a watchdog timer (BLUE_WDT) is activated, and BLUE control message 200 is fed back 258 during Generating state 256 to keep UCAV SMS 108 operating as commanded in message 200.

If BLUE control message 200 is not proper, for example, after the watchdog timer has expired, message 200 conflicts with a previous control message 200, and/or is a control message 200 is received out of sequence, state machine 250 enters 260 a "Protocol Fail" state 262 (Prot_Fail) from Idle state 252 rather than entering 254 Generating state 256. In Protocol Fail state 262, UCAV SMS 108 is operated in a fail-safe mode in which the BLUE output is set to OFF. Further, Protocol Fail state 262 may be entered 264 from Generating state 256 if the next BLUE control message 200 is not proper, as discussed above. In the exemplary embodiment, after Protocol Fail state 262, state machine 250 returns 266 to Idle state 252, and awaits further BLUE control messages 200.

From Generating state 256, state machine 250 may return 268 to Idle state 252 if a reset command is received in BLUE control message 200. If UCAV SMS 108 receives an expected message while in Generating state 256, state machine 250 enters 270 an "Enable" state 272. In the exemplary embodiment, Enable state 272 is reached from Generating state 256 after an Enable command with count==1 is received. During Enable state 272, the BLUE outputs are set to ON, and the watchdog timer is re-initiated on entry. Enable state 272 may be re-entered after an Enable command with count==count+1 is received. As such, if SMS 108 receives the initial message having a count of 1 rather than 0, a "handshake" between UCAV SMS 108 and ground station SMS 110 has been completed. In the exemplary embodiment, during Enable state 272, weapons 146 (shown in FIG. 1) are armed. BLUE control message 200 is fed back 274 during Enable state 272 and a count of the watchdog timer is incremented to indicate that the arm command is not "stale". Enable state 272 continues until critical control messages 400 and 500 are received, message 200 fails, message 200 is reset, and/or message 200 expires.

More specifically, if BLUE control message 200 fails for being improper, for example, after the watchdog timer has expired, message 200 conflicts with previous a message 200, and/or message 200 is received out of sequence, state machine 250 enters 276 Protocol Fail state 262 and the BLUE output is set to OFF. If BLUE control message 200 is reset, state machine 250 returns 278 to Idle state 252. If BLUE control message 200 expires, for example, count==max_count, an "Expired" state 280 is entered 282 from Enable state 272. In one embodiment, max_count is a maximum number of BLUE control messages 200 received without receiving critical control messages 400 and 500. As such, UCAV SMS 108 cannot remain armed indefinitely. As such, a weapon 146 cannot be inadvertently released after a predetermined time period from activation of master arm switch 124 (shown in FIG. 1) has elapsed. From Expired state 280, state machine 250 returns 284 to Idle state 252.

Figure 4:
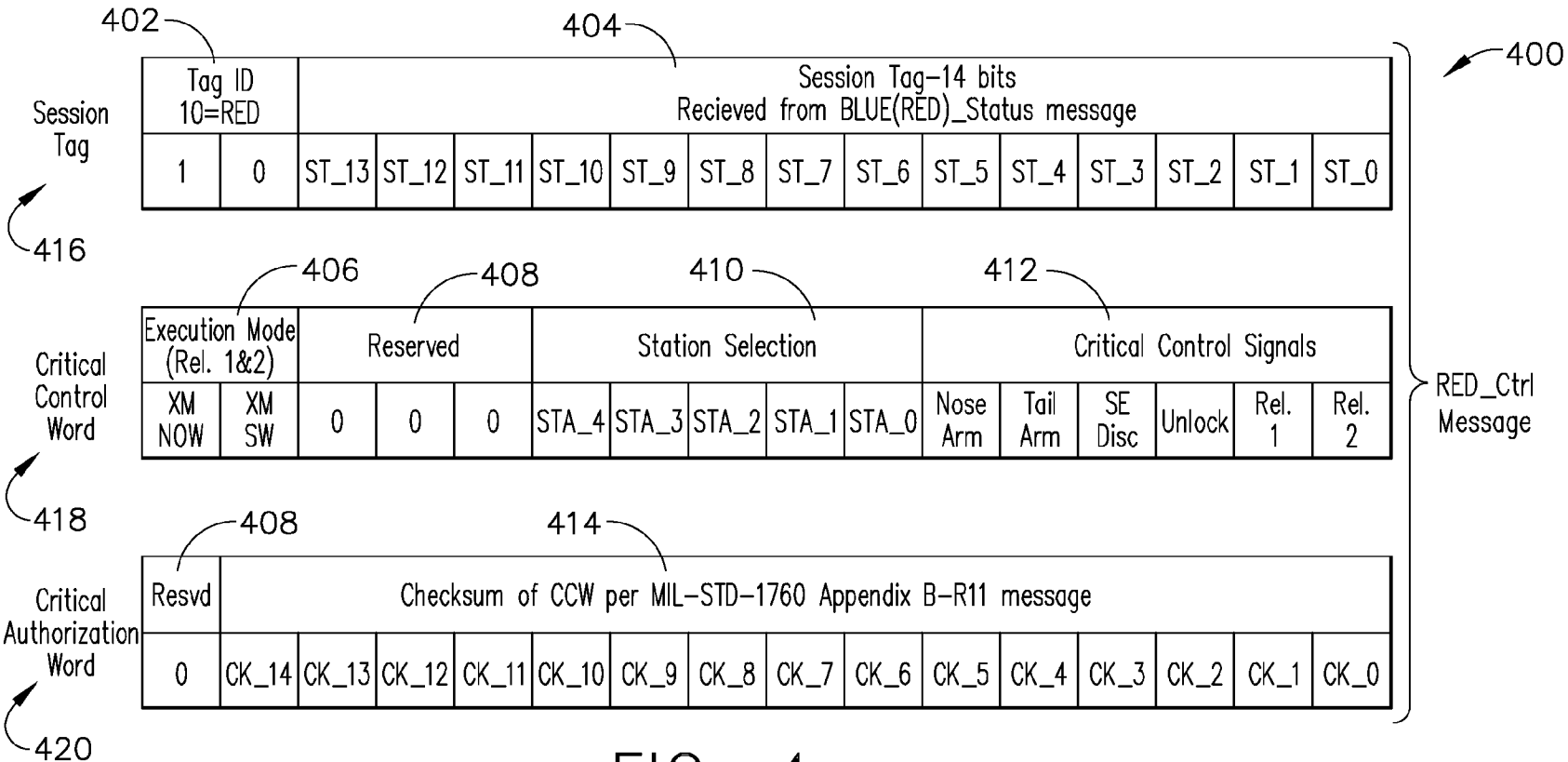
FIG. 4 is diagram of an exemplary first critical control message that may be used with the protocol shown in FIG. 1.

FIG. 4 is diagram of first critical control message 400 that may be used with protocol 100. In the exemplary embodiment, RED control message 400 includes a tag identification 402, a session tag section 404, an execution mode 406, a reserved section 408, a station selection 410, critical control signals 412, an a checksum 414. Tag identification 402 and session tag section 404 form a Session Tag 416, and execution mode 406, station selection 410, and critical control signals 412 form a Critical Control Word 418. Alternatively, Critical Control Word 418 may include any suitable data for critical control of weapons 146 (shown in FIG. 1) on UCAV 104 (shown in FIG. 1). In the exemplary embodiment, checksum 414 forms a Critical Authorization Word 420.

In the exemplary embodiment, Session Tag 416 is compared to session tag 312 (shown in FIG. 2) of BLUE status message 300 (shown in FIG. 2). If session tags 416 and 312 match, a weapon 146 can be released. If session tags 416 and 312 do not match, a weapon 146 cannot be released and UCAV SMS 108 (shown in FIG. 1) enters Protocol Fail state 262 (shown in FIG. 3). In the exemplary embodiment, Critical Authorization Word 420 is a high integrity checksum for guaranteeing that any error in the transmission of RED control message 400 does not effect other components of UCAV SMS 108.

Execution mode 406, in the exemplary embodiment, includes data indicating in which execution mode UCAV SMS 108 should operate. More specifically, UCAV SMS 108 can release a weapon 146 upon receiving RED and GREEN control messages 400 and 500 (XM_NOW) or UCAV SMS 108 can calculate a release time for a weapon 146 after RED and GREEN control messages 400 and 500 are received (XM_SW). In one embodiment, the human operator chooses which execution mode to use. In an alternative embodiment, UCAV SMS 108 is programmed to select the execution mode depending on the type of unmanned platform.

In the exemplary embodiment, station selection 410 includes data indicating from which station on UCAV 104 a weapon 146 should be released. More specifically, each weapon 146 on UCAV 104 is at a respective station position on UCAV 104 and includes a corresponding SPC 186 (shown in FIG. 1). As such, when the human operator selects a specific weapon to release, the corresponding station identifier is coded in RED control message 400 at station selection 410. In the exemplary embodiment, UCAV 104 includes five stations (STA_0, STA_1, STA_2, STA_3, and STA_4), however, UCAV 104 may include any suitable number of stations.

Critical control signals 412 include, in the exemplary embodiment, data indicating how to release a weapon. Critical control signals 412 vary based on the type of weapon. In the exemplary embodiment, weapon 146 is a bomb and critical control signals 412 include data indicating whether a nose of the bomb is armed (Nose Arm), whether a tail of the bomb is armed (Tail Arm), information about safety enable discreet (SE Disc), a command to unlock a mechanism holding the bomb to UCAV 104 (Unlock), such as SPC 186, a first release command (Rel. 1), and a second release command (Rel. 2).

Figure 5:
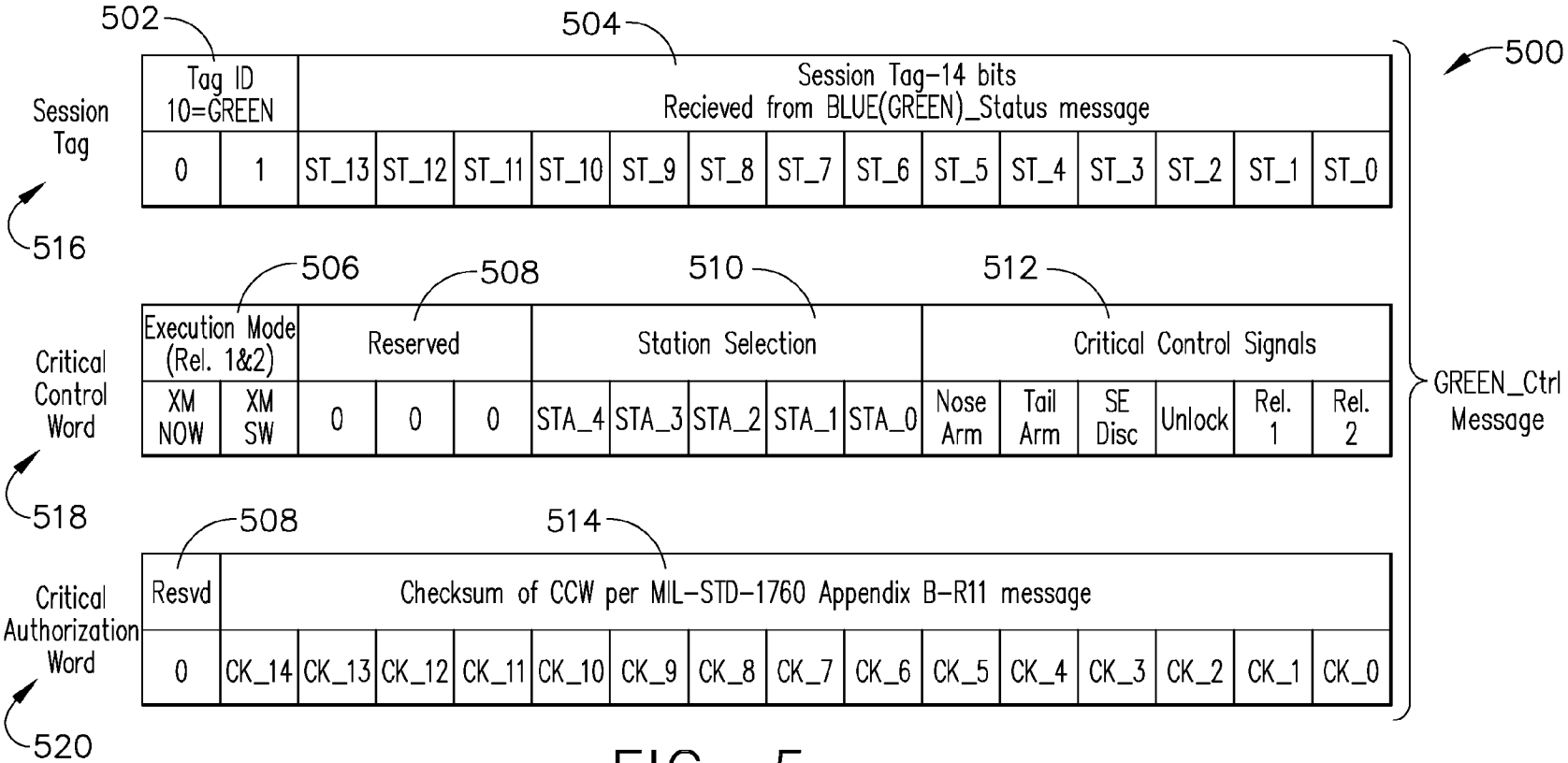
FIG. 5 is diagram of an exemplary second critical control message that may be used with the protocol shown in FIG. 1.

FIG. 5 is diagram of second critical control message 500 that may be used with protocol 100 (shown in FIG. 1). In the exemplary embodiment, RED control message 400 (shown in FIG. 4) and GREEN control message 500 are duplicate messages that encode the same critical control information. As such, GREEN control message 500 is the same as RED control message 400. More specifically, in the exemplary embodiment, GREEN control message 500 includes a tag identification 502, a session tag section 504, an execution mode 506, a reserved section 508, a station selection 510, critical control signals 512, an a checksum 514. Tag identification 502 and session tag section 504 form a Session Tag 516. Execution mode 506, station selection 510, and critical control signals 512 form a Critical Control Word 518. Alternatively, Critical Control Word 518 may include any suitable data for critical control of weapons 146 (shown in FIG. 1) on UCAV 104 (shown in FIG. 1). In the exemplary embodiment, checksum 514 forms a Critical Authorization Word 520.

In the exemplary embodiment, Session Tag 516 is compared to session tag 312 (shown in FIG. 2) of BLUE status message 300 (shown in FIG. 2). If session tags 516 and 312 match, a weapon 146 can be released. If session tags 516 and 312 do not match, a weapon 146 cannot be released and UCAV SMS 108 (shown in FIG. 1) enters Protocol Fail state 262 (shown in FIG. 3). In the exemplary embodiment, Critical Authorization Word 520 is a high integrity checksum for guaranteeing that any error in the transmission of GREEN control message 500 does not effect other components of UCAV SMS 108.

Execution mode 506, in the exemplary embodiment, includes data indicating in which execution mode UCAV SMS 108 should operate. More specifically, UCAV SMS 108 can release a weapon 146 upon receiving RED and GREEN control messages 400 and 500 (XM_NOW) or UCAV SMS 108 can calculate a release time for a weapon after RED and GREEN control messages 400 and 500 are received (XM_SW). In one embodiment, the human operator chooses which execution mode to use. In an alternative embodiment, UCAV SMS 108 is programmed to select the execution mode depending on the type of unmanned platform.

In the exemplary embodiment, station selection 510 includes data indicating from which station on UCAV 104 a weapon 146 should be released. More specifically, each weapon 146 coupled to UCAV 104 is at a respective UCAV station that includes a corresponding SPC 186. As such, when the human operator selects a specific weapon to release, the corresponding station identifier is coded in GREEN control message 500 at station selection 510. In the exemplary embodiment, UCAV 104 includes five stations (STA_0, STA_1, STA_2, STA_3, and STA_4), however, UCAV 104 may include any suitable number of stations.

Critical control signals 512 include, in the exemplary embodiment, data indicating how to release a weapon. Critical control signals 512 vary based on the type of weapon. In the exemplary embodiment, weapon 146 is a bomb and critical control signals 512 include data indicating whether a nose of the bomb is armed (Nose Arm), whether a tail of the bomb is armed (Tail Arm), information about safety enable discreet (SE Disc), a command to unlock a mechanism holding the bomb to UCAV 104 (Unlock), such as SPC 186, a first release command (Rel. 1), and a second release command (Rel. 2).

Figure 6:
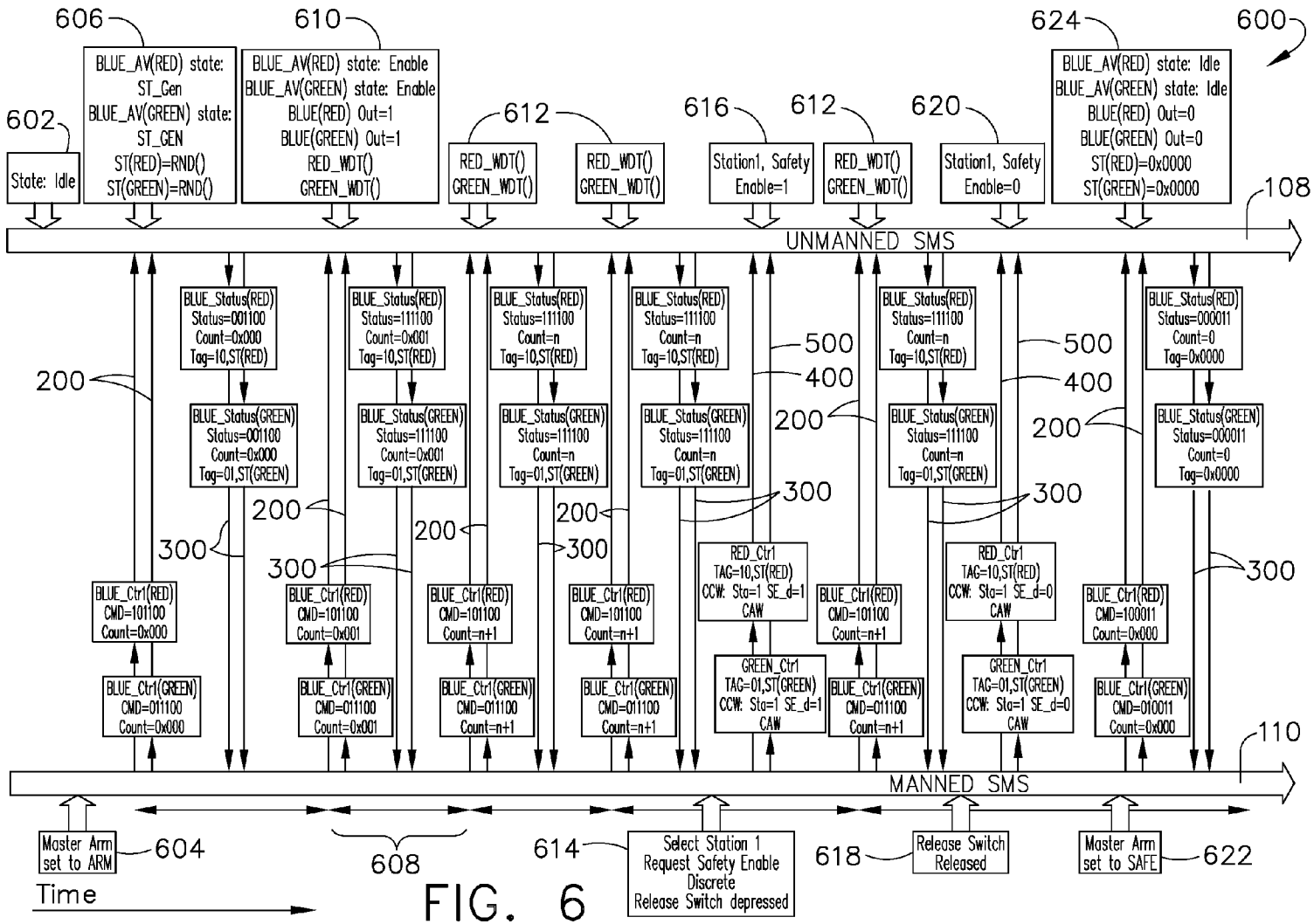
FIG. 6 is a diagram of a exemplary control sequence that may be performed using the protocol shown in FIG. 1.

FIG. 6 is a diagram of a exemplary control sequence 600 that may be performed using protocol 100. Initially, UCAV SMS 108 (shown in FIG. 1) is operating 602 in Idle state 252 (shown in FIG. 3). In the exemplary embodiment, sequence 600 includes the human operator selecting 604 to ARM weapons 146 (shown in FIG. 1) using master arm control switch 124 (shown in FIG. 1). Ground station SMS 110 (shown in FIG. 1) generates BLUE control message 200 including information to arm weapons 146 on UCAV 104 (shown in FIG. 1). More specifically, in the exemplary embodiment, each BLUE control message 200 includes two parts, wherein each part corresponds to a respective critical control message 400 or 500.

After UCAV SMS 108 receives BLUE control message 200, SMS 108 enters 606 Generating state 256 (shown in FIG. 3) and transmits BLUE status message 300 to ground station SMS 110 indicating that weapons 146 are not yet armed (status=001100). Ground station SMS 110 receives BLUE status message 300, and after a predetermined watchdog interval 608, transmits BLUE control message 200 again, except having a count incremented by 1. UCAV SMS 108 receives incremented BLUE control message 200 and enters 610 Enable state 272 (shown in FIG. 3) from Generating state 256. More specifically, by receiving incremented BLUE control message 200, UCAV SMS 108 verifies that a "handshake" has been established with ground station SMS 110 and enters 610 Enable state 272. At the end of a second interval 608, ground station SMS 110 transmits another incremented BLUE control message 200, and, upon receiving incremented BLUE control message 200, UCAV SMS 108 increments 612 a watchdog timer and transmits BLUE status message 300. At each watchdog interval 608 until RED and GREEN control messages 400 and 500 are transmitted by ground station SMS 110, ground station SMS 110 transmits an incremented BLUE control message 200 and UCAV SMS 108 increments 612 the watchdog timer and transmits BLUE status message 300 in response.

After UCAV SMS 108 is in Enable state 272, the human operator at ground station 102 activates trigger switch 126 (shown in FIG. 1). More specifically, in the exemplary embodiment, the human operator selects 614 station 1 on UCAV 104 and requests safety enable discreet by depressing trigger switch 126. When trigger switch 126 is activated 614, ground station SMS 110 transmits RED control message 400 and GREEN control message 500 to UCAV SMS 108. UCAV SMS 108 receives RED and GREEN control messages 400 and 500 and compares messages 400 and 500 to last received BLUE control message 200. If the session tags match, UCAV SMS 108 changes 616 a status of station 1 to safety enable=1. After RED and GREEN control messages 400 and 500 have been transmitted, ground station SMS 110 continues transmitting incremented BLUE control messages 200 at each watchdog interval 608. As such, UCAV SMS 108 continues incrementing 612 the watchdog time and transmitting BLUE status messages 300 in response.

After station 1 is at safety enable=1, the human operator releases 618 trigger switch 126. Ground station SMS 110 transmits RED and GREEN control messages 400 and 500 including information to set station 1 to safety enable=0. When UCAV SMS 108 receives RED and GREEN control messages 400 and 500 and verifies messages 400 and 500 against BLUE control message 200, UCAV SMS 108 changes 620 the status of station 1 to safety enable=0. The next BLUE control message 200 sets 622 master arm control switch 124 to SAFE and resets 624 UCAV SMS 108 to Idle state 252. UCAV SMS 108 transmits BLUE status message 300 to ground station SMS 110, wherein BLUE status message 300 includes a new session tag for the next ARMED session. It will be understood that sequence 600 is exemplary only, and any RED and GREEN control messages 400 and 500 may be transmitted by ground station SMS 110 to UCAV SMS 108.

The above-described store management systems and protocols extend a RED/GREEN/BLUE safety architecture of manned platforms to unmanned platforms by providing separation of Master Arm and Release/Trigger controls. Such a protocol on an unmanned platform addresses safe operation during a transient in the control of an unmanned vehicle and/or unmanned platform. More specifically, the embodiments described herein tie commands to specific store payload controllers (SPC), such as a specific station, and a specific control session to facilitate preventing acceptance by the unmanned platform of misdirected and/or "stale" commands. Additional authentication on control message is left to the control data link, which is platform specific.

Further, the above-described protocol individually interlocks all of the possible critical control commands to a store using different interlock equations. As such, the hard-wired interlocks used with manned platforms are extended to specific bit patterns in data provided to a store and/or weapon to facilitate mitigating potential platform dependent software hazards, as compared to unmanned platforms having a single hardware interlock for all weapon critical functions, which may create safety critical software hazards.

The master arm switch and the trigger switch, or cockpit control switches, described herein are encoded in a ground station using a strong checksum. More specifically, a master arm command is encoded in a BLUE control message, and a release and selected station command is encoded in RED/GREEN messages. When multiple weapon stations are activated, multiple RED/GREEN messages are transmitted to the unmanned platform. Further, the unmanned SMS described herein receives RED/GREEN/BLUE messages and decodes them via independent hardware logic. More specifically, the unmanned SPC operational flight program (OFP) can inhibit critical control outputs, but cannot enable critical control outputs without RED/GREEN/BLUE messages from the manned platform. Moreover, data structures and associated state machines facilitate preventing the "re-use" of RED/GREEN/BLUE control messages to mitigate any potential hazard in the transmission channel and/or the components of the OFP that manage delivery of RED/GREEN/BLUE messages to critical control hardware.

The BLUE control message described herein represents the equivalent of the Master Arm control in a manned cockpit. More specifically, the BLUE control message encodes the position of the master arm switch in the manned platform, implements a rolling counter to ensure that master arm commands are continuously received while the master arm switch is enabled, and includes a serial number field matching the BLUE control message to a specific SPC. The above-described BLUE control message also includes a strong checksum that validates the data fields of the BLUE control message, as decoded in the hardware of the unmanned SMS. The BLUE control message described herein controls the status of a BLUE state machine within an SPC. More specifically, the BLUE control message has a corresponding BLUE status message that reports to the manned platform the commanded state of the master arm, the current master arm counter, and/or the actual state of the BLUE air gap.

The above-described RED and GREEN control messages represent the equivalent of a release command, such as a command from a trigger switch and/or pickle switch, from a manned cockpit. Additionally, the above-described RED/GREEN control messages encode a station for which a release command is intended and specifics of what critical control discretes are required to be activated in response to the release command. The RED and GREEN control elements, such as encoders and decoders, described herein are essentially duplicate hardware elements that independently evaluate commands received from the manned platform. The two independent elements are used to eliminate single point failures within the critical sub-systems of the unmanned SMS. More specifically, the RED and GREEN control structures described herein are very similar, but include sufficient unique information to ensure that both the RED control message and the GREEN control message need to be received before a weapon is released. For example, duplicating the same data structure to both the RED and GREEN elements will not cause a command to be executed because at least one of the two data structures will not be recognized. Further, the Session Tag field in each data structure ties the command to a current master arm session. More specifically, the Session Tag field includes the Tag data received via the BLUE status message for the corresponding RED/GREEN messages. As such, the Tag data will differ for the RED and GREEN messages, and will be re-initialized each time that the master arm state machine is activated.

Exemplary embodiments of a store management system and method of operating the same are described above in detail. The methods and systems are not limited to the specific embodiments described herein, but rather, components of systems and/or steps of the methods may be utilized independently and separately from other components and/or steps described herein. For example, the methods may also be used in combination with other control and/or management systems and methods, and are not limited to practice with only the store management systems and methods as described herein. Rather, the exemplary embodiment can be implemented and utilized in connection with many other remote management and/or control applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for controlling an unmanned platform including a dis-assembler from a manned station including an assembler, said method comprising:

transmitting a master arm control message from the manned station to the unmanned platform via a first control path through the assembler and the dis-assembler;

transmitting a first critical control message from the manned station to the unmanned platform via a second control path through the assembler and the dis-assembler, the second control path independent of the first control path, the first critical control message including a session tag linked to the master arm control message; and transmitting a second critical control message from the manned station to the unmanned platform via a third control path through the assembler and the dis-assembler, the third control path independent from the first control path and the second control path, the second critical control message including a session tag linked to the master arm control message.

2. A method in accordance with claim 1 further comprising:

receiving the master arm control message at a dedicated master arm control message decoder in the unmanned platform;

receiving the first critical control message at a dedicated first critical control message decoder in the unmanned platform; and receiving the second critical control message at a dedicated second critical control message decoder in the unmanned platform, wherein the master arm control message decoder, the first critical control message decoder, and the second critical control message decoder are each in communication with the dis-assembler.

3. A method in accordance with claim 2 further comprising comprising:

comparing the first critical control message session tag and the second critical control message session tag to the master arm control message;

comparing the first critical control message and the second critical control message to each other;

generating a release signal when the session tags match the master arm control signal and the first critical control message and the second critical control message match each other.

4. A method in accordance with claim 2 further comprising changing a state of the unmanned platform from an Idle state to a Generating state after receiving the master arm control message.

5. A method in accordance with claim 2 further comprising changing a state of the unmanned platform from a Generating state to an Enable state after receiving the master arm control message.

6. A method in accordance with claim 2 further comprising incrementing a watchdog timer on the unmanned platform after receiving the master arm control message.

7. A method in accordance with claim 2 further comprising changing a state of the unmanned platform from an Enable state to an Idle state after receiving the first and second critical control messages.

8. A method in accordance with claim 1 further comprising transmitting a master arm status message from the unmanned platform to the manned station after receiving the master arm control signal.

9. A method in accordance with claim 1 wherein transmitting a master arm control message from the manned station to the unmanned platform via a first control path further comprises transmitting a sequence of master arm control messages from the manned station to the unmanned platform via the first control path, wherein each master arm control message of the sequence of master arm control messages is transmitted at a predetermined time interval.

10. A store management system (SMS) comprising:

a manned station comprising a master arm control message encoder, a first critical control message encoder, a second critical control message encoder, and an assembler in communication with said master arm control message encoder, said first critical control message encoder, and said second critical control message encoder;

an unmanned platform comprising a master arm control message decoder, a first critical control message decoder, a second critical control message decoder, and a dis-assembler in communication with said master arm control message decoder, said first critical control message decoder, and said second critical control message decoder; and a data link between said assembler of said manned station and said dis-assembler of said unmanned platform, said data link configured to:

transmit a master arm control message from said master arm control message encoder to said master arm control message decoder via a first control path;

transmit a first critical control message from said first critical control message encoder to said first critical control message decoder via a second control path independent from the first control path, the first critical control message including a session tag linked to the master arm control message; and transmit a second critical control message from said second critical control message encoder to said second critical control message decoder via a third control path independent from the first control path and the second control path, the second critical control message including a session tag linked to the master arm control message.

11. An SMS in accordance with claim 10 further comprising a separate master arm control station comprising a secondary master arm control message encoder and a secondary data link, said secondary data link configured to transmit a secondary master arm control message from said secondary master arm control message encoder to said master arm control message decoder.

12. An SMS in accordance with claim 10 wherein said unmanned platform is configured to:

compare said first critical control message session tag and said second critical control message session tag to said master arm control message;

compare said first critical control message and said second critical control message to each other;

release a weapon when said session tags match said master arm control message said first critical control message and said second critical control message match each other.

13. An SMS in accordance with claim 10 wherein said unmanned platform further comprises a watchdog timer, said master arm control message configured to increment said watchdog timer.

14. An SMS in accordance with claim 10 wherein said second critical control message is a duplicate of said first critical control message and sent substantially simultaneously with said first critical control message.

15. An SMS in accordance with claim 10 wherein said master arm control message encoder is separate from said first critical control message encoder and said second critical control message encoder, and said first critical control message encoder is separate from said second critical control message encoder.

16. An SMS in accordance with claim 10 wherein said master arm control message decoder is separate from said first critical control message decoder and said second critical control message decoder, and said first critical control message decoder is separate from said second critical control message decoder.

17. An SMS in accordance with claim 10 wherein said data link comprises:

a first antenna at said manned station; and a second antenna at said unmanned platform, said first and second antennas configured to communicate using radio frequencies.

18. An SMS in accordance with claim 10 wherein said unmanned platform further comprises:

a power bus switch coupled in communication with said master arm control message decoder;

a first transistor coupled in communication with said first critical control message decoder; and a second transistor coupled in communication with said second critical control message decoder, wherein said power bus switch, said first transistor, and said second transistor are coupled in series.

19. An SMS in accordance with claim 10 wherein said unmanned platform further comprises:

a power bus switch coupled in communication with said master arm control message decoder;

a plurality of first transistors coupled in communication with said first critical control message decoder, said plurality of first transistors including n first transistors; and a plurality of second transistors coupled in communication with said second critical control message decoder, said plurality of second transistors including n second transistors, wherein n is equal to a number of weapon stations on said unmanned platform.

* * * * *